US008806703B2

(12) United States Patent
Bassett

(10) Patent No.: US 8,806,703 B2
(45) Date of Patent: Aug. 19, 2014

(54) VACUUM CLEANERS

(75) Inventor: Alexander Anthony Denny Bassett, Kenilworth (GB)

(73) Assignee: Hoover Limited, Merthyr Tydfil (GB)

( * ) Notice: Subject to any disclaimer, the term of this patent is extended or adjusted under 35 U.S.C. 154(b) by 708 days.

(21) Appl. No.: 13/041,550

(22) Filed: Mar. 7, 2011

(65) Prior Publication Data

US 2011/0214245 A1 Sep. 8, 2011

(30) Foreign Application Priority Data

Mar. 8, 2010 (GB) ..... 1003750.5
Jun. 1, 2010 (GB) ..... 1009084.3

(51) Int. Cl.
*A47L 7/00* (2006.01)

(52) U.S. Cl.
USPC ..... 15/320; 15/345; 15/346; 15/302

(58) Field of Classification Search
USPC ..... 15/320, 345, 346, 302
See application file for complete search history.

(56) References Cited

U.S. PATENT DOCUMENTS

| | | | | |
|---|---|---|---|---|
| 5,502,872 | A * | 4/1996 | Chae et al. | 15/320 |
| 6,530,113 | B2 * | 3/2003 | Zahorik et al. | 15/302 |
| 7,523,524 | B2 * | 4/2009 | Mitsumori et al. | 15/321 |
| 8,561,254 | B2 * | 10/2013 | Roden | 15/326 |
| 2001/0034922 | A1 * | 11/2001 | Ko | 15/320 |
| 2002/0162187 | A1 * | 11/2002 | Keller | 15/345 |

FOREIGN PATENT DOCUMENTS

| | | | | |
|---|---|---|---|---|
| EP | 2364632 | A2 | 9/2011 | |
| GB | 2436786 | | 10/2007 | |
| JP | 07255654 | A * | 10/1995 | A47L 9/28 |

* cited by examiner

*Primary Examiner* — Joseph J Hail
*Assistant Examiner* — Henry Hong
(74) *Attorney, Agent, or Firm* — Gordon & Jacobson, PC

(57) ABSTRACT

A vacuum cleaner includes a device for dispensing atomized liquid, the device having a reservoir for holding liquid and an ultrasonic transducer arranged to atomize the liquid in the reservoir. An airflow is created through the reservoir via the exhaust gasflow from the vacuum cleaner, the airflow carrying the atomized liquid via an elongate tube to dispensing outlet provided on a cleaning head of the vacuum cleaner. The ultrasonic transducer is simple and inexpensive, yet is able to reliably atomize the liquid for dispensing.

15 Claims, 4 Drawing Sheets

VACUUM CLEANERS

CROSS-REFERENCE TO RELATED APPLICATIONS

This application claims benefit from UK Application No. 1003750.5, filed Mar. 8, 2010, and UK Application No. 1009084.3, filed Jun. 1, 2010, both of which are hereby incorporated by reference in its entirety.

BACKGROUND OF THE INVENTION

1. Field of the Invention

This invention relates to vacuum cleaners incorporating means for dispensing atomized liquids into the atmosphere or onto the surface being cleaned.

2. Related Background Art

When cleaning floors and other surfaces, its often desirable to dispense fluid onto the surface, which freshens, disinfects or otherwise treats the surface being cleaned.

Vacuum cleaners are known which incorporate means for dispensing atomized liquids onto the surface being cleaned. Once such vacuum cleaner is disclosed in GB2436786 and comprises an aerosol, which is mounted on the cleaning wand and which can be actuated to spray liquids onto the surface being cleaned. Such aerosols are expensive to purchase and are harmful to the environment. Accordingly, an alternative way of atomising liquids is needed.

It is known to use heat to atomize liquids. However, the use of heat in a domestic vacuum cleaner is undesirable, since it increases energy consumption and creates a potential fire risk. Also, heated liquid can harm the surface being cleaned. Other known devices for atomising liquid can be difficult to control and hence can over wet the surface being cleaned.

Accordingly, an object of the present invention is to provide a vacuum cleaner which solves the above-mentioned problems.

SUMMARY OF THE INVENTION

In accordance with the present invention, as seen from a first aspect, there is provided a vacuum cleaner comprising a device for dispensing atomized liquid, the device comprising a reservoir for holding liquid and an ultrasonic transducer arranged to atomize the liquid in the reservoir, the vacuum cleaner further comprising means for creating an airflow through the reservoir to carry the atomized liquid to a dispensing outlet of the vacuum cleaner.

The ultrasonic transducer creates a mist of liquid, which is then conveyed into the atmosphere or onto the surface being cleaned by the airflow. Ultrasonic transducers consume very little power and are inexpensive in construction. Furthermore, the frequency and/or amplitude of the output of the ultrasonic transducer can preferably be controlled to vary the quantity of liquid being dispensed. The use of an ultrasonic transducer also avoids the need for any heating devices or pumps to atomize the liquid.

Preferably said means for creating an airflow through the reservoir comprises a fan, which is primarily arranged to draw air from a cleaning head through a dust separation device of the cleaner and to exhaust clean air into the atmosphere.

Preferably the reservoir comprises an air inlet connected to a point downstream of said fan, such as a point at or adjacent an exhaust outlet for said cleaned air.

It will be appreciated that the use of exhaust from the vacuum cleaner enables an airflow to be created through the reservoir in a simple manner and without the need for an additional fan. The use of exhaust in this way also avoids consumption of increased power.

Preferably the ultrasonic transducer is disposed on the bottom wall of the reservoir, so that substantially all of the liquid in the reservoir can be dispensed.

Preferably the reservoir can be refilled with liquid, for example by opening a closure provided on a wall of the reservoir.

Preferably said airflow is directed over the surface of the liquid in the reservoir, so as to carry away the layer of atomized liquid particles existing above the liquid.

Preferably the reservoir comprises a boundary wall which divides the reservoir into two compartments, the boundary wall terminating above the liquid in the reservoir, such that air supplied to one compartment passes under the boundary wall into the other compartment and over the surface of the liquid.

Preferably the dispensing outlet is positioned adjacent a suction inlet of the cleaner, so that the reduced pressure created by the suction adjacent the dispensing outlet further serves to enhance the airflow through the reservoir.

Preferably the reservoir is mounted on the body of the cleaner, the dispensing device further comprising an elongate duct for conveying the airflow out of the reservoir to said dispensing outlet.

Preferably said duct extends along or inside an elongate flexible duct arranged to carry dirty air from the cleaning head of the vacuum cleaner into the body of the vacuum cleaner.

Preferably said dispensing outlet is disposed on the cleaning head and is arranged to direct atomized liquid onto the surface being cleaned.

Preferably said dispensing outlet comprises a plurality of apertures.

It is also envisaged that the atomizer may be provided as an accessory for fitting to existing vacuum cleaners. Accordingly, in accordance with the present invention, as seen from a second aspect, there is provided a liquid atomizer device for fitting to a vacuum cleaner, the device comprising a reservoir for holding liquid and an ultrasonic transducer arranged to atomize the liquid in the reservoir, the reservoir having an air inlet and an air outlet arranged such that an airflow through the reservoir conveys the atomized liquid to a surface being cleaned.

Preferably the device comprises a cleaning head for fitting to the vacuum cleaner, the head having a suction inlet connected to an outlet port for coupling to an elongate wand or hose which conveys the air to the body of the cleaner.

Preferably the head comprises a dispensing outlet for the atomized liquid connected to said air outlet of the reservoir.

Preferably said dispensing outlet is disposed adjacent said suction inlet so that the reduced pressure created by the suction adjacent the dispensing outlet creates said airflow through the reservoir.

Preferably, the suction inlet is disposed in a bottom wall of the head, the dispensing outlet being disposed on a front wall of the head and is preferably directed downwardly such that atomized liquid is directed onto the floor surface being cleaned.

Preferably said dispensing outlet comprises a plurality of apertures.

Preferably the device comprises a battery for energising said ultrasonic transducer.

Preferably the device comprises an actuator for varying the frequency and/or amplitude of the output of the ultrasonic transducer to vary the quantity of liquid being dispensed.

Preferably the ultrasonic transducer is disposed on a bottom wall of the reservoir, so that substantially all of the liquid in the reservoir can be dispensed.

Preferably the reservoir can be refilled with liquid, for example by opening a closure provided on the device.

Preferably said reservoir is arranged to direct the airflow over the surface of the liquid therein, so as to carry away the layer of atomized liquid particles existing above the liquid.

Preferably the reservoir comprises a boundary wall which divides the reservoir into two compartments, the boundary wall terminating above the liquid in the reservoir, such that air entering one compartment from the air inlet passes under the boundary wall into the other compartment and over the surface of the liquid.

BRIEF DESCRIPTION OF THE DRAWINGS

Embodiments of the present invention will now be described by way of example only and with reference to the accompanying drawings, in which.

DETAILED DESCRIPTION OF THE PREFERRED EMBODIMENT

Figure 1:
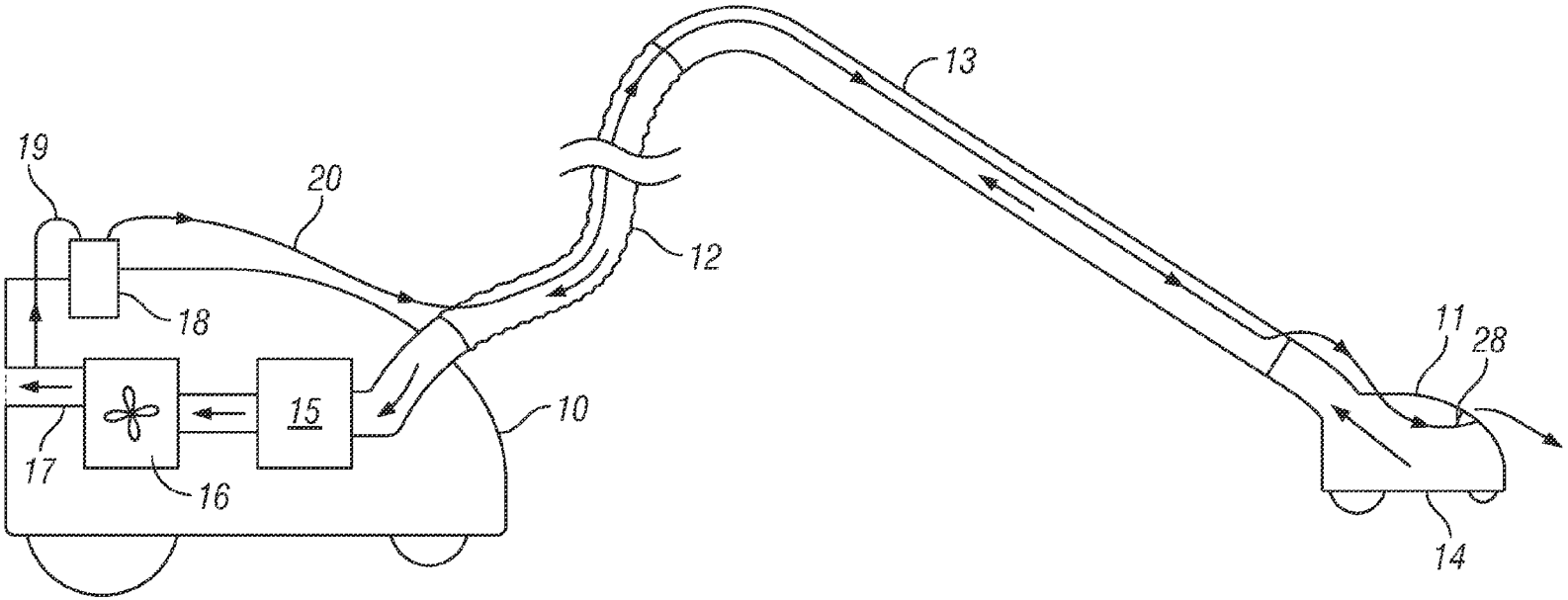
FIG. 1 is a schematic side view of a vacuum cleaner in accordance with the first aspect of the present invention.

Referring to FIG. 1 of the drawings, there is shown a vacuum cleaner of the so-called cylinder type, which comprises a body 10 connected to a floor cleaning head 11 via an elongate flexible tube 12 and a rigid wand 13. In use, dirty air is drawn through a suction inlet 14 in the underside of the cleaning head 11, whereupon it travels along the wand 13 and flexible hose 12 into the body 10 of the cleaner. The dirty air is then drawn through a dust separation device 15 by a motor/fan unit 16. The cleaned air is then output into the atmosphere through an exhaust duct 17.

It will be appreciated that the vacuum cleaner as hereinbefore described is a conventional vacuum cleaner. However, in accordance with the present invention, the vacuum cleaner further comprises a dispensing device for dispensing cleaning liquids or other liquid treatments onto the surface being cleaned. The dispensing device comprises a reservoir 18 mounted in or on the body 10 of the vacuum cleaner.

Figure 2:
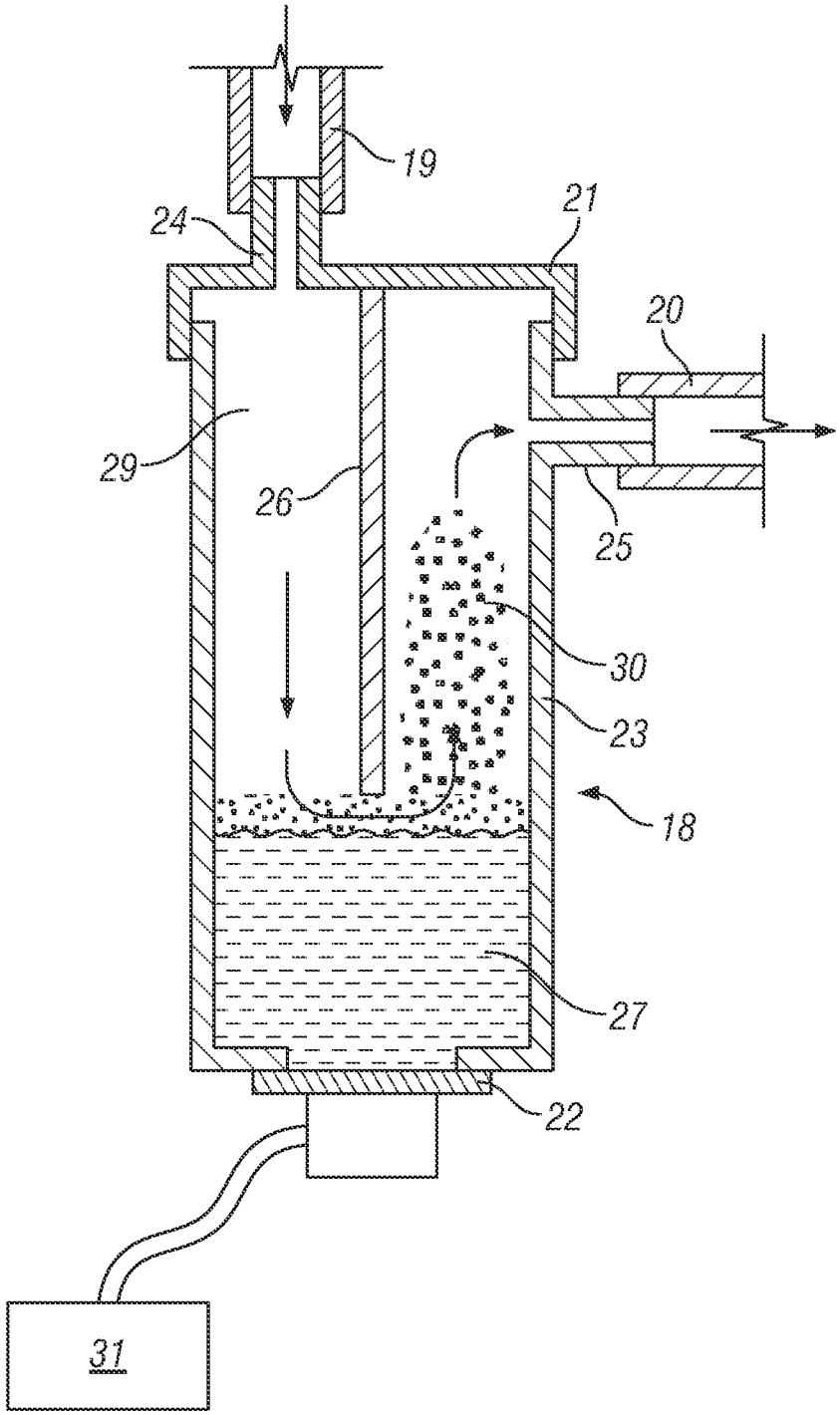
FIG. 2 is a sectional view through a dispensing device of the vacuum cleaner of FIG. 1.

Referring also to FIG. 2 of the drawings, the reservoir 18 comprises an air inlet 24 at its upper end, which is connected to the exhaust duct 17 of the vacuum cleaner by a tube 19. The reservoir 18 also comprises an air outlet duct 25, which connected to the cleaning head 11 of the vacuum cleaner by an elongate flexible tube 20, which extends along the flexible hose 12 and rigid wand 13 to dispensing outlet 28 provided on the front wall of the cleaning head 11. Preferably the tube 20 extends inside the flexible hose and wand 13 so that it is hidden from view. It may also extend inside the body 10 of the vacuum cleaner, rather than externally as shown.

The reservoir 18 comprises a tubular sidewall 23, which is closed at its upper end by a removable closure 21 on which the inlet 24 is provided. An ultrasonic transducer 22 is mounted across an opening formed in the bottom wall of the reservoir 18. The reservoir 18 is divided into two longitudinally-extending compartments 29,30 by a boundary wall 26. The boundary wall 26 seals against the closure 21 at its upper end and terminates at its lower end at a point above the uppermost fluid fill level in the reservoir 18.

In use, when the vacuum cleaner is operating, a portion of the pressurised air in the exhaust duct 17 flows along the tube 19 into the first compartment 29 of the reservoir 18. The ultrasonic transducer 22 is energised by a signal sufficient to cause vibrations in the liquid 27, which create a layer of atomized liquid particles over the surface of the liquid 27 in the reservoir 18. The airflow into the first compartment 29 of the reservoir 18 then passes under the boundary wall 26 and over the surface of the liquid 27 in the reservoir 18, so as to carry the layer of atomized liquid particles existing above the liquid 27 into the second compartment 30 of the reservoir 18 and along the elongate pipe 20 to the cleaning head 11. The dispensing outlet 28 on the cleaning head 11 then directs the atomized liquid onto the surface being cleaned. The dispensing 28 outlet is positioned adjacent a suction inlet 14 of the cleaner, so that the reduced pressure created by the suction adjacent the dispensing outlet 28 further serves to enhance the airflow through the reservoir 18.

The ultrasonic transducer 22 is controlled by a control circuit 31, which is preferably provided with an actuator, which can be controlled by a user to turn the dispensing device on and off and to control the amount of liquid being dispensed.

Figure 3:
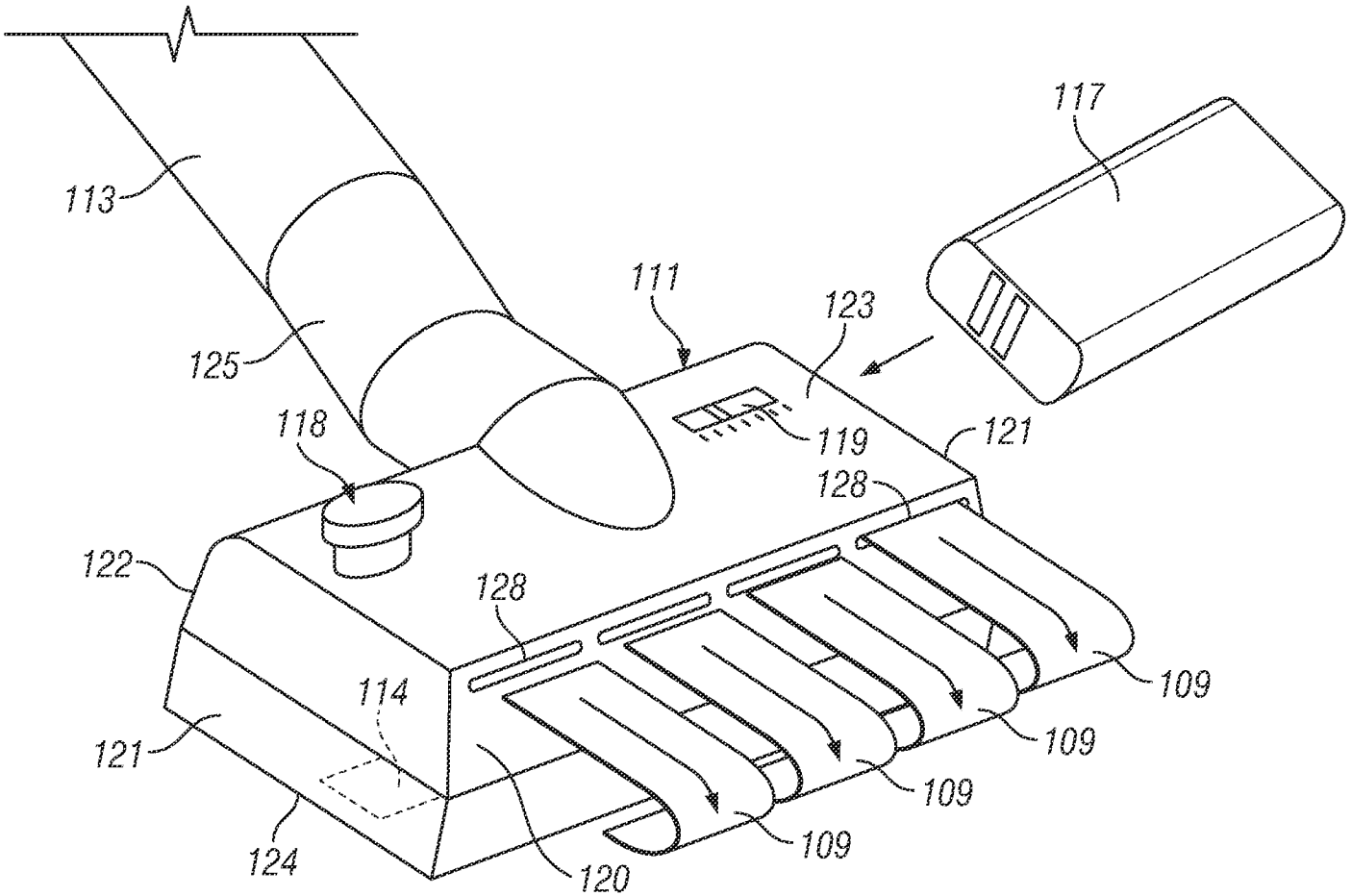
FIG. 3 is a perspective view of a cleaning head in accordance with the second aspect of the present invention.
Figure 4:
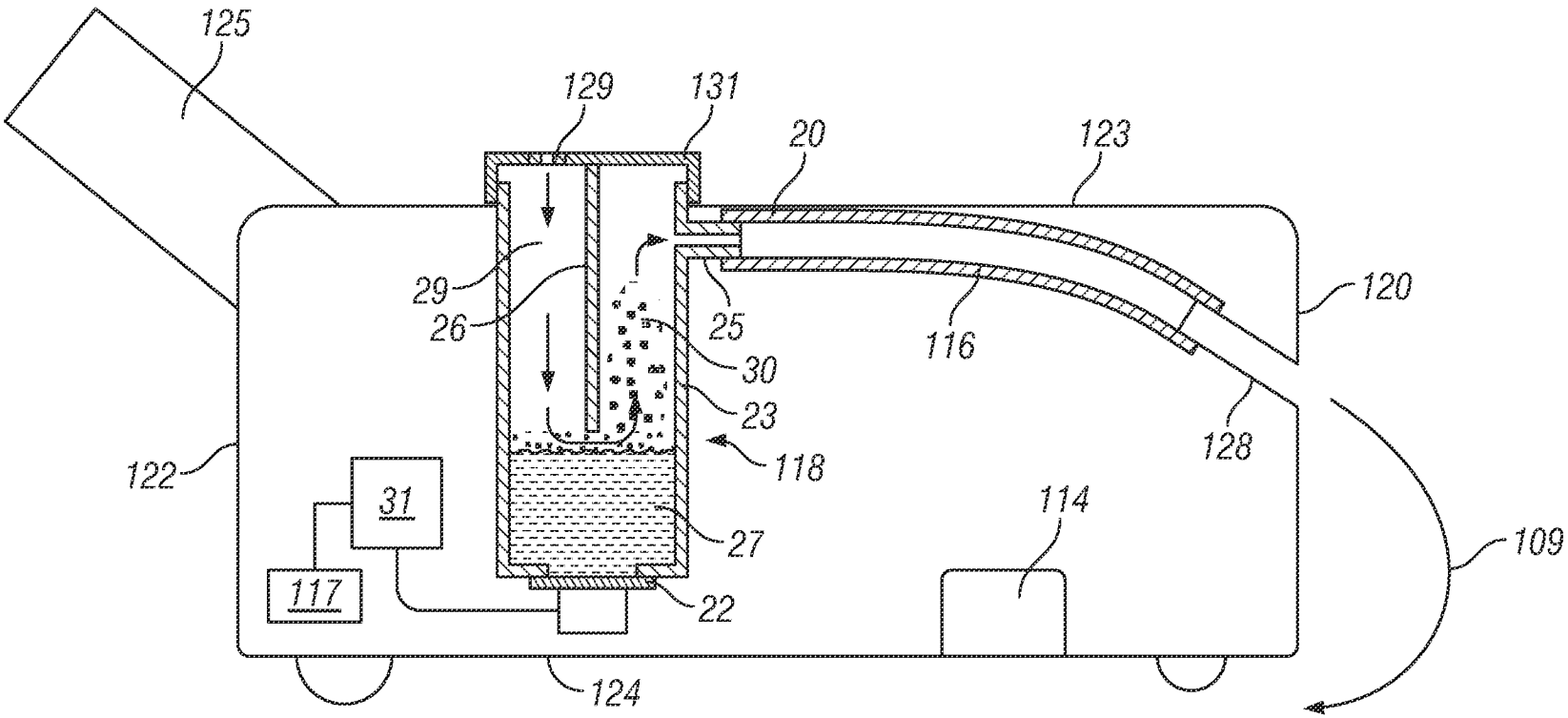
FIG. 4 is a sectional view through the head of FIG. 3.

Referring to FIGS. 3 and 4 of the drawings, there is shown a cleaning head 111 for fitting to the elongate wand 113 of a conventional vacuum cleaner. The head 111 comprises a front wall 120, opposite side walls 121, a rear wall 122, a top wall 123 and a bottom wall 124. A suction inlet 114 extends transverse the bottom wall 124, the inlet 114 being connected via an internal duct (not shown) to a port 125 extending rearwardly from the rear wall 122 and arranged for coupling with the distal end of the elongate wand 113.

A plurality of downwardly-directed dispensing outlets 128 are arranged in line across the front wall 120. A reservoir 118 of the kind shown in FIG. 2 is disposed inside the head 111 and like parts are given like reference numerals. In this embodiment the closure 131 is positioned above the top wall 123 of the head 111 for easy filling of the reservoir 118. The closure 131 is provided with a series of small apertures 129 which take the place of the air inlet port 24 in FIG. 2, although it will be appreciated that an air inlet could be provided in the upper side wall of the compartment 29. The air outlet port 25 is connected via a pipe 116 directly to the dispensing outlets 128.

The ultrasonic transducer 22 is controlled by the control circuit 31, which is connected to an actuator 119 on the top wall 123 that is arranged to be controlled by a user to turn the dispensing device on and off and to control the amount of liquid being dispensed. The control circuit 31 is powered by a battery 117.

In use, when the device 111 is fitted to a vacuum cleaner and the cleaner is energised, the reduced pressure created by the suction applied to the suction inlet 114 adjacent the dispensing outlet 28 creates an airflow through the reservoir 118. The atomized liquid are drawn from the reservoir 118 along the pipe 116 to the dispensing outlet 128, which directs jets 109 of the atomized liquid onto the surface being cleaned.

It will be appreciated that the vacuum cleaner in accordance with the first aspect of the present invention can thus be provided by fitting a device in accordance with the second aspect of the present invention to a conventional vacuum cleaner. The present invention thus provides a simple and inexpensive way to reliably dispense controlled amounts of atomized liquid onto the surface being cleaned by a vacuum cleaner.

While the preferred embodiment of the invention has been shown and described, it will be understood by those skilled in the art that changes of modifications may be made thereto without departing from the true spirit and scope of the invention.

I claim:

1. A vacuum cleaner comprising a device for dispensing atomized liquid, the device comprising a tubular reservoir having a bottom portion for holding liquid and an ultrasonic transducer arranged to atomize the liquid in the reservoir, the vacuum cleaner further comprising a fan for creating an airflow through the reservoir to carry the atomized liquid through a dispensing outlet of the vacuum cleaner, wherein the reservoir comprises a boundary wall which extends inside the reservoir and divides the reservoir into two compartments, the boundary wall terminating above the bottom portion of the reservoir, the ultrasonic transducer located in the reservoir below the boundary wall, and the fan arranged to create an airflow through one compartment which passes under the boundary wall into the other compartment and over the surface of the liquid in the bottom portion.

2. A vacuum cleaner as claimed in claim 1, in which the vacuum cleaner includes a body housing a motor, a floor cleaning head with a suction inlet, the motor forming a vacuum which creates suction at the suction inlet of the floor cleaning head to draw air outside the floor cleaning head through the suction inlet and into a dust separation device, whereupon the air is then passed through to an exhaust.

3. A vacuum cleaner as claimed in claim 2, in which said fan is arranged to draw air from a cleaning head of the vacuum cleaner through a dust separation device and to exhaust cleaned air into the atmosphere.

4. A vacuum cleaner as claimed in claim 3, in which the reservoir comprises an air inlet connected to a point downstream of said fan.

5. A vacuum cleaner as claimed in claim 1, in which the ultrasonic transducer is disposed on a bottom wall of the reservoir.

6. A vacuum cleaner as claimed in claim 1, in which the reservoir comprises a removable closure enabling the reservoir to be refilled with liquid.

7. A vacuum cleaner as claimed in claim 1, in which the dispensing outlet is positioned adjacent a suction inlet of the cleaner.

8. A vacuum cleaner as claimed in claim 1, in which the reservoir is mounted on a body of the cleaner, the dispensing device further comprising an elongate duct for conveying the airflow out of the reservoir to said dispensing outlet.

9. A vacuum cleaner as claimed in claim 8, in which said duct extends along or inside an elongate flexible duct arranged to carry dirty air from the cleaning head of the vacuum cleaner to the body of the vacuum cleaner.

10. A vacuum cleaner as claimed in claim 1, in which said dispensing outlet is disposed on the cleaning head of the vacuum cleaner and is arranged to direct atomized liquid onto the surface being cleaned.

11. A vacuum cleaner as claimed in claim 1, in which said dispensing outlet comprises a plurality of apertures.

12. A vacuum cleaner as claimed in claim 2, in which the cleaning head comprises an outlet port connected to the suction inlet, the outlet port further being coupled to an elongate wand extending from the body of the cleaner.

13. A vacuum cleaner as claimed in claim 12, in which the suction inlet is disposed in a bottom wall of the head, the dispensing outlet being disposed on a front wall of the head.

14. A vacuum cleaner as claimed in claim 12, in which the dispensing outlet is directed downwardly.

15. A vacuum cleaner as claimed in claim 1, further comprising a battery for energizing said ultrasonic transducer.

* * * * *